US010006267B2

(12) United States Patent
Rogers et al.

(10) Patent No.: US 10,006,267 B2
(45) Date of Patent: Jun. 26, 2018

(54) EXPANSION CONE FOR DOWNHOLE TOOL

(71) Applicant: Halliburton Energy Services, Inc., Houston, TX (US)

(72) Inventors: Henry Eugene Rogers, Oklahoma City, OK (US); Patrick Lyle Cherney, Newton, KS (US)

(73) Assignee: Halliburton Energy Services, Inc., Houston, TX (US)

( * ) Notice: Subject to any disclaimer, the term of this patent is extended or adjusted under 35 U.S.C. 154(b) by 86 days.

(21) Appl. No.: 15/107,276

(22) PCT Filed: Feb. 11, 2014

(86) PCT No.: PCT/US2014/015677
§ 371 (c)(1),
(2) Date: Jun. 22, 2016

(87) PCT Pub. No.: WO2015/122871
PCT Pub. Date: Aug. 20, 2015

(65) Prior Publication Data

US 2016/0341000 A1 Nov. 24, 2016

(51) Int. Cl.

| | |
|---|---|
| ***E21B 33/128*** | (2006.01) |
| ***E21B 33/14*** | (2006.01) |
| ***E21B 34/10*** | (2006.01) |
| ***E21B 34/14*** | (2006.01) |
| *E21B 34/00* | (2006.01) |

(52) U.S. Cl.
CPC ..... *E21B 33/1285* (2013.01); *E21B 33/14* (2013.01); *E21B 34/10* (2013.01); *E21B 34/14* (2013.01); *E21B 2034/007* (2013.01)

(58) Field of Classification Search
CPC ..... E21B 23/06; E21B 43/10; E21B 33/1208; E21B 34/14; E21B 33/129; E21B 33/1295; E21B 33/1293; E21B 33/128
See application file for complete search history.

(56) References Cited

U.S. PATENT DOCUMENTS

| | | | |
|---|---|---|---|
| 4,842,082 | A | 6/1989 | Springer |
| 5,024,273 | A | 6/1991 | Coone et al. |
| 5,038,862 | A | 8/1991 | Giroux et al. |
| 5,279,370 | A | 1/1994 | Brandell et al. |
| 5,314,015 | A | 5/1994 | Streich et al. |
| 5,526,878 | A | 6/1996 | Duell et al. |
| 6,568,471 | B1 | 5/2003 | Cook et al. |
| 7,044,221 | B2 | 5/2006 | Cook et al. |
| 7,779,910 | B2 | 8/2010 | Watson |

(Continued)

OTHER PUBLICATIONS

International Search Report and Written Opinion dated Nov. 11, 2014, issued in priority PCT Application No. PCT/US2014/015677.

(Continued)

*Primary Examiner* — Zakiya W Bates
(74) *Attorney, Agent, or Firm* — McAfee & Taft

(57) ABSTRACT

A downhole tool for creation of an annular seal in a well and a method of cementing a casing in a well, wherein tool and method make use of an expansion cone. The expansion cone is driven through a portion of the tool having a sealing element on the wellbore side so that the portion is expanded and the sealing element brought into contact with the wellbore. A force multiplier is used to increase the force exerted on the expansion cone by fluid pressure.

20 Claims, 6 Drawing Sheets

(56) References Cited

U.S. PATENT DOCUMENTS

| | | | | |
|---|---|---|---|---|
| 9,238,952 | B2 | 1/2016 | Rogers et al. | |
| 2004/0031610 | A1 | 2/2004 | Schultz et al. | |
| 2004/0238181 | A1 | 12/2004 | Cook et al. | |
| 2006/0213668 | A1 | 9/2006 | Cook et al. | |
| 2008/0257560 | A1 | 10/2008 | Brisco et al. | |
| 2009/0200040 | A1 | 8/2009 | Smith, Jr. et al. | |
| 2010/0051276 | A1 | 3/2010 | Rogers et al. | |
| 2011/0220356 | A1 | 9/2011 | Rogers et al. | |
| 2012/0222868 | A1 | 9/2012 | Hazelip | |
| 2016/0024896 | A1* | 1/2016 | Johnson | E21B 33/1208 166/302 |

OTHER PUBLICATIONS

Patent Examination Report No. 1 dated Aug. 11, 2016, issued in counterpart Australian Patent Application 2014382687.

* cited by examiner

EXPANSION CONE FOR DOWNHOLE TOOL

FIELD OF THE INVENTION

The present invention relates generally to equipment and methods used in subterranean wells and, more particularly, to the use of expansion cones for the creation of annular seals downhole.

BACKGROUND

In downhole and drilling operations, it is often necessary to create an annular seal in the well in order to isolate one zone from another for such operations as installing casing and/or cementing zones of the well. For example, in the drilling of deep wells, it is often desirable to cement the casing in the wellbore in separate stages, beginning at the bottom of the well and working upwards. This process is achieved by placing cementing tools, which are primarily valved ports, in the casing or between joints of casing at one or more locations in the wellbore, flowing cement through the bottom of the casing, up the annulus to the lowest cementing tool, closing off or sealing the bottom, opening the cementing tool, and then flowing cement through the cementing tool up the annulus to the next upper stage and repeating the process until all stages of cementing the well are completed. The cementing tools often utilize sealing elements to create an annular seal between the tool and the wellbore or well casing prior to displacing cement into the well through the tool.

In another example, during the drilling and completing of oil wells, heavy steel casing is sometimes placed in a well and cement is placed between the casing and the well to anchor the casing in place and prevent migration of fluids outside the casing. After an upper portion of a well has been drilled and cased, it is common to continue drilling the well and to line a lower portion of the well with a liner lowered through the upper cased portion of the well. Liner hangers have been used to mechanically support the upper end of the liner from the lower end of the previously set casing and to seal the liner to the casing. Liner hangers have included slips for mechanical support and packers for forming a seal.

In both these applications and in others, elastomeric rings carried on a section of expandable tubing have been used to form the seal. When the seal is needed, an expansion cone can be forced through the tubing to expand the elastomeric rings into contact with the casing to provide both mechanical support and a fluid seal. One problem with the use of such systems is the amount of fluid pressure needed to drive the expansion cone through the expandable tubing. Often the fluid pressure has to be high enough that it can be problematic for other components of the tool, such as rupture disks, sometimes used to prevent premature entry of cement into well zones.

BRIEF DESCRIPTION OF THE DRAWINGS

FIGS. 6A and 6B are a cross section of the tool after cementing operations have been completed.

DETAILED DESCRIPTION

The invention will be described below with respect to a downhole tool for cementing the casing in the wellbore in separate stages, beginning at the bottom of the well and working upwards. It should be understood and will be readily apparent to those skilled in the art that the invention is applicable in other downhole tools where it is desired to create an annular seal; for example, liner applications for cementing wells beginning at the top and working down, as discussed above. In the following discussion and in the claims, the terms "having," "including" and "comprising" are used in an open-ended fashion, and thus should be interpreted to mean "including, but not limited to . . . " Reference to up or down will be made for purposes of description with "up," "upper," "upward," "upstream" or "above" meaning toward the surface of the wellbore and with "down," "lower," "downward," "down-hole," "downstream" or "below" meaning toward the terminal end of the well, regardless of the wellbore orientation.

Figure 1:
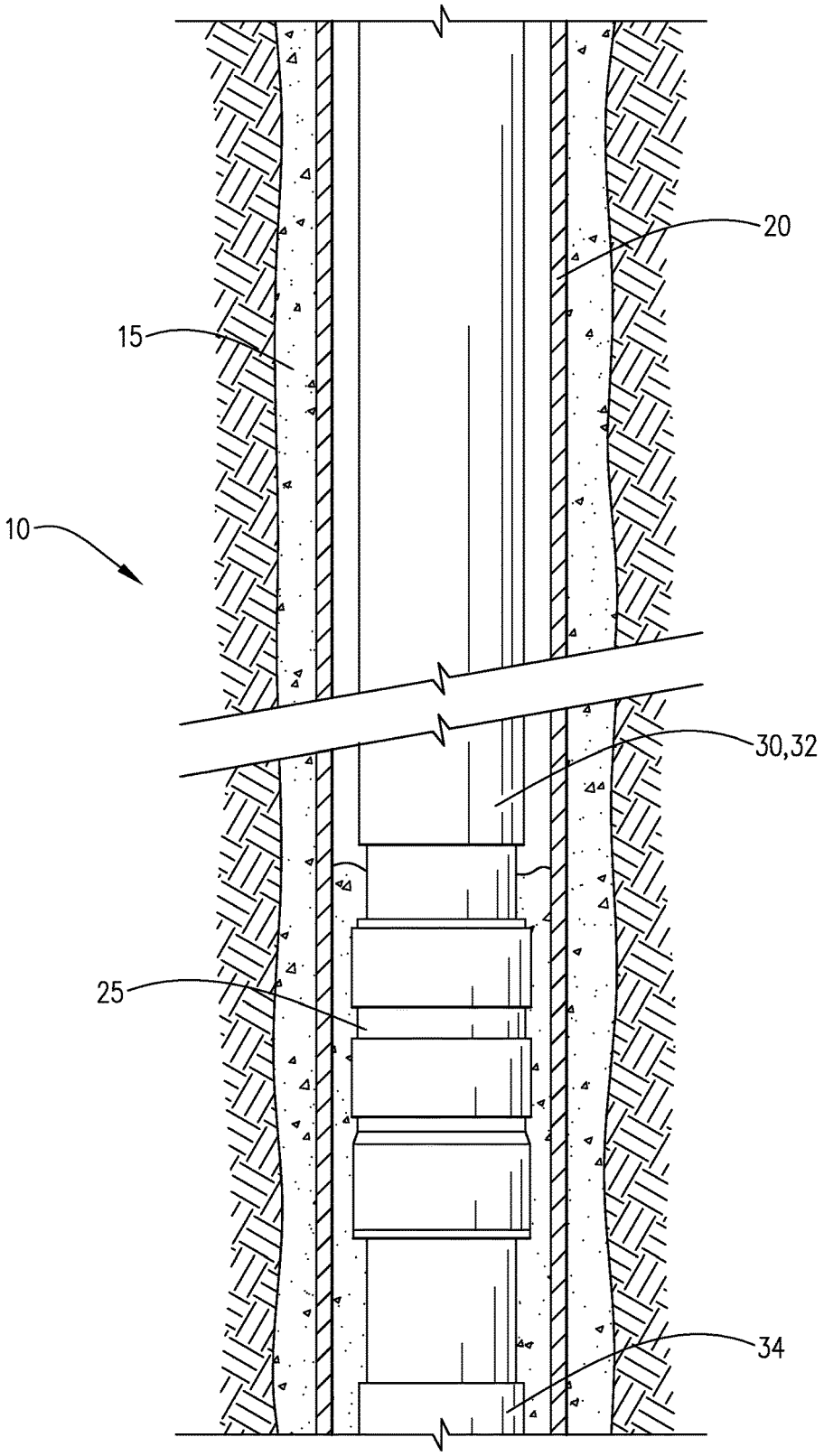
FIG. 1 schematically shows a tool lowered into a well.

As shown in FIG. 1, well 10 comprises a wellbore 15 with a casing 20, which may be referred to as a previously installed casing 20, cemented therein. A cementing tool 25 is lowered into casing 20 on a liner 30, which is known in the art and may be referred to herein as casing 30. Casing 30 has upper portion 32 and lower portion 34 with cementing tool 25 connected therebetween.

FIG. 1 shows the cement level above cementing tool 25. As known in the art, lower cementing portion 34 may have float equipment thereon, so that cement passes therethrough into wellbore 15. Cement is displaced therethrough to cement lower casing portion 34 in wellbore 15. When the level of the cement is at, or preferably above, cementing tool 25 as shown in FIG. 1, cement may be flowed through cementing tool 25 to cement upper casing portion 32 in well 10 and, more specifically, in previously installed casing 20. With cementing tool 25, it is not necessary to wait until the cement below tool 25 hardens. Thus, cementing of upper casing portion 32 can begin as soon as a desired amount of cement has been displaced through the lower end of casing 30 to cement the lower portion 34 in wellbore 15. FIG. 1 is representative of cementing tool 25 after such cementing of the lower portion 34 has occurred but prior to the time cementing tool 25 is expanded to seal against casing 20.

Referring now to FIGS. 2-6, cementing tool 25 comprises an inner mandrel 36 which defines a central flow passage 37 therethrough. An outer mandrel 38 is positioned about inner mandrel 36. Outer mandrel 38 and inner mandrel 36 define an annular space 40 therebetween. As will be explained in greater detail hereinbelow, fluid pressure communicated through central flow passage 37 will be communicated into annular space 40 to cause the plastic deformation of outer mandrel 38 so that seals affixed thereto will engage previously installed casing 20 to seal thereagainst. Cementing may thus occur above cementing tool 25 to cement the upper portion 32 of casing 30 in the well, and cementing can occur prior to the time the cement around lower portion 34 hardens.

Inner mandrel 36 has upper end 42 adapted to be connected to a casing. For example, upper end 42 may be threaded so that a coupling 43 may be attached thereto which will then connect to upper portion 32 of casing 30. Lower end 44 of inner mandrel 36 is likewise adapted to be connected to a casing. For example, lower end 44 may have a thread on an outer surface thereof to connect to lower portion 34 of casing 30. It is understood that lower portion 34 may have a float collar or float shoe or other arrangement thereon whereby cement will pass through a lower end of lower portion 34 and into the annulus between wellbore 15 and lower portion 34. Cement will be displaced therethrough until a sufficient amount of cement is in the annulus and has filled the annulus to a location above annular space 40.

Inner mandrel 36 comprises an upper portion 46, which may be referred to as the upper inner mandrel 46. Upper inner mandrel 46 has outer surface 45 and inner surface 47. Upper inner mandrel 46 is a generally cylindrical tube having upper end 42, which is the upper end of inner mandrel 36. Inner mandrel 36 comprises a lower portion, or lower inner mandrel 48 having lower end 44, which is the lower end of inner mandrel 36. Lower inner mandrel 48 may also be referred to as a housing 48 to which sleeves utilized in the operation of cementing tool 25 are connected. Lower inner mandrel 48 has an outer surface 49 and an inner surface 50.

Figures 3A, 3B:
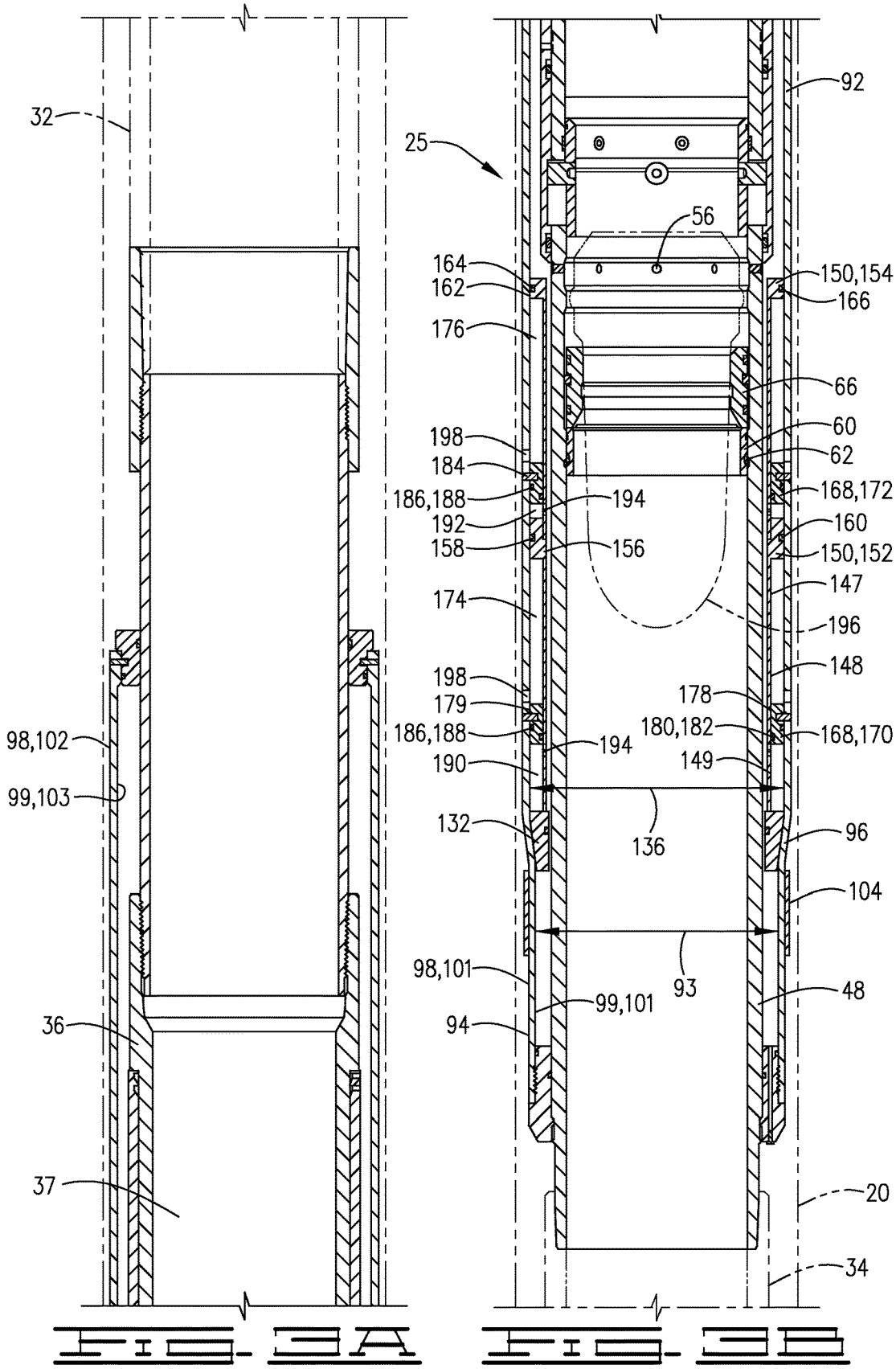
FIGS. 3A and 3B are a cross section of the tool after the opening sleeve has moved.
Figure 4A:
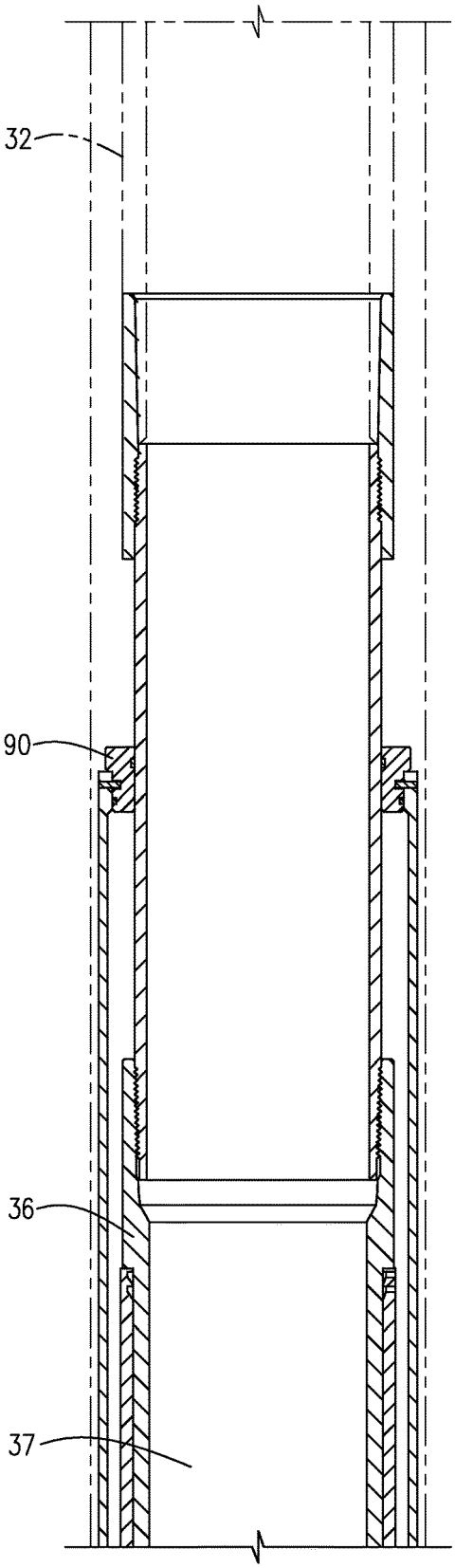
FIGS. 4A and 4B are a cross section of the tool with the outer mandrel expanded.
Figure 4B:
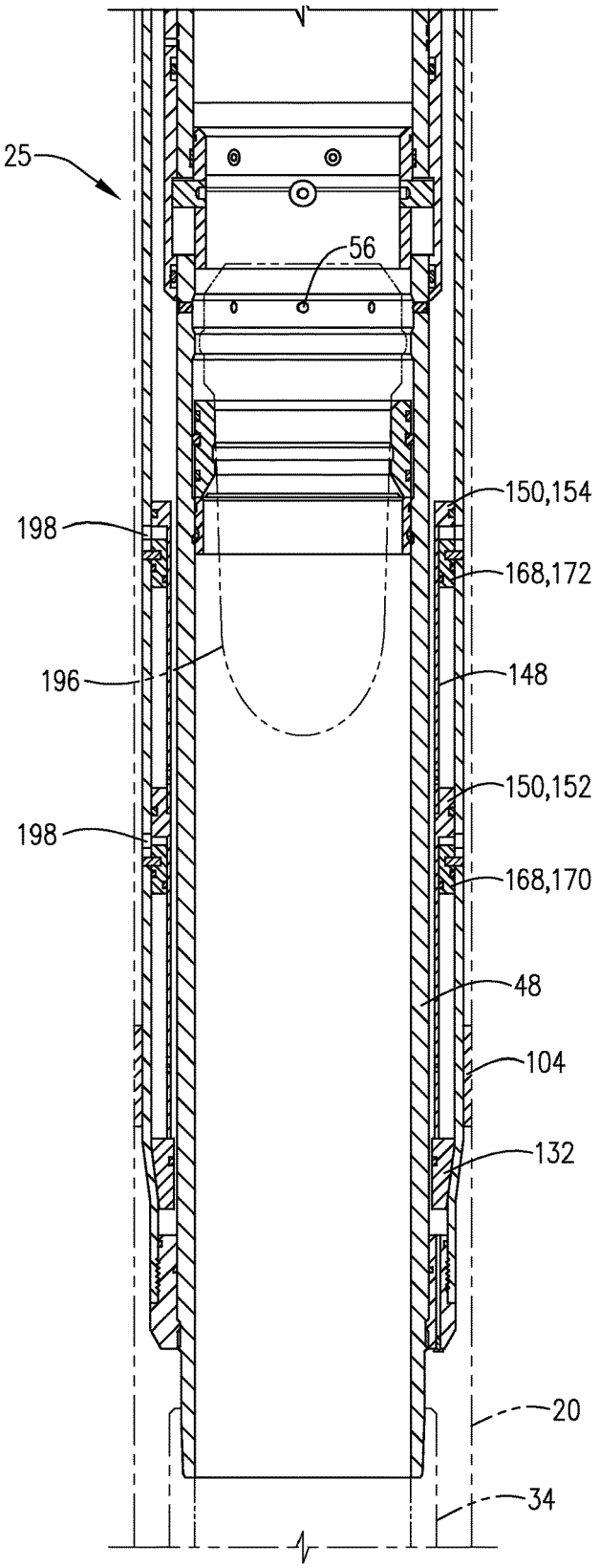
Figures 5A, 5B:
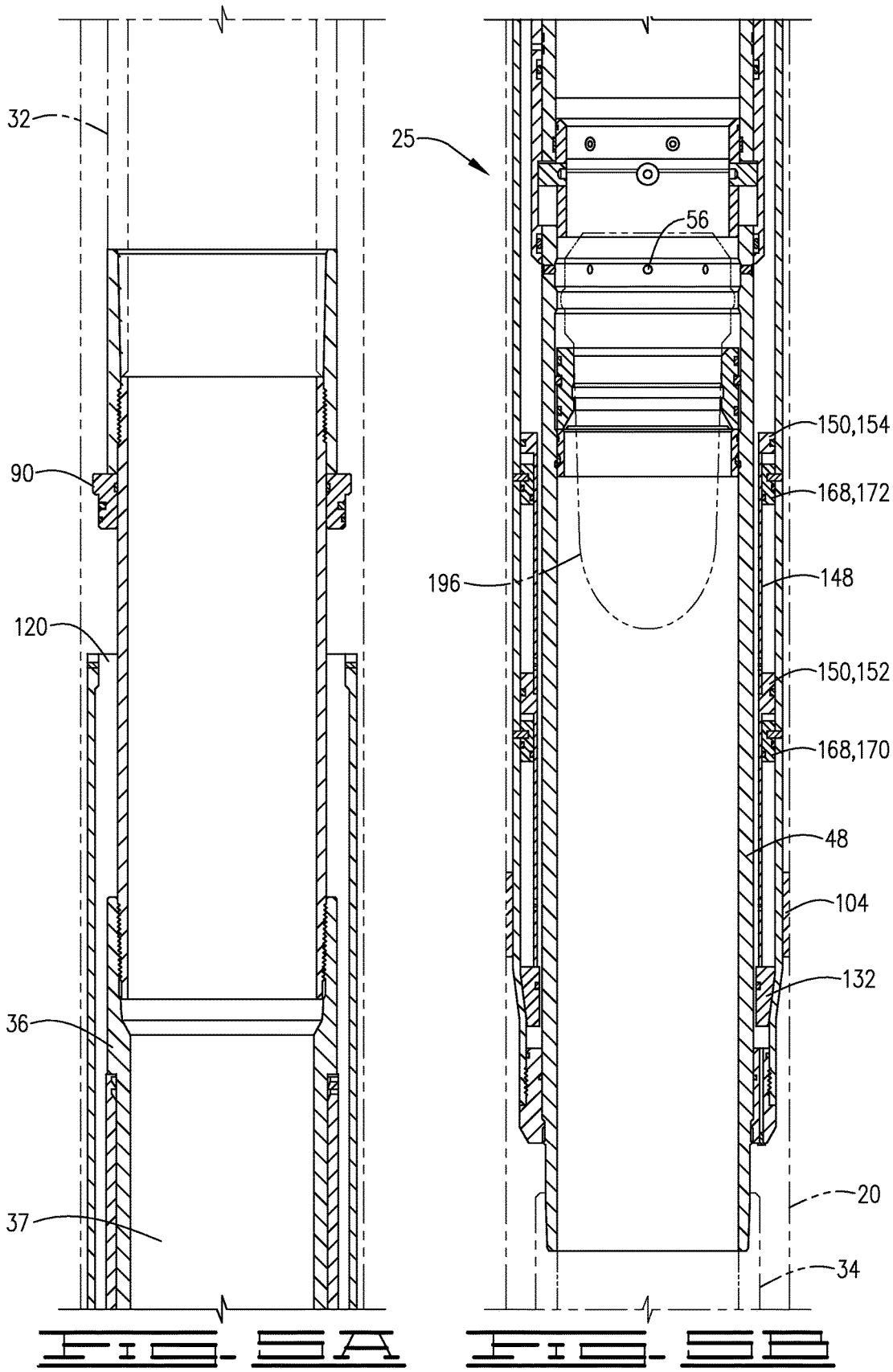
FIGS. 5A and 5B are a cross section of the tool during cementing operations.
Figure 5A:
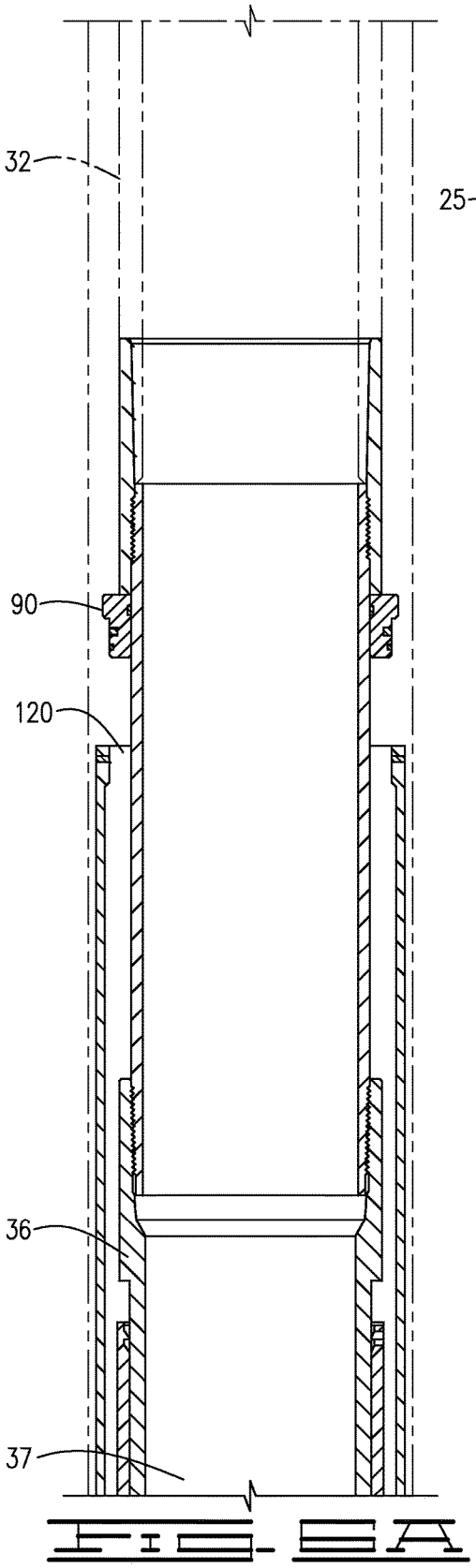
Figure 5B:
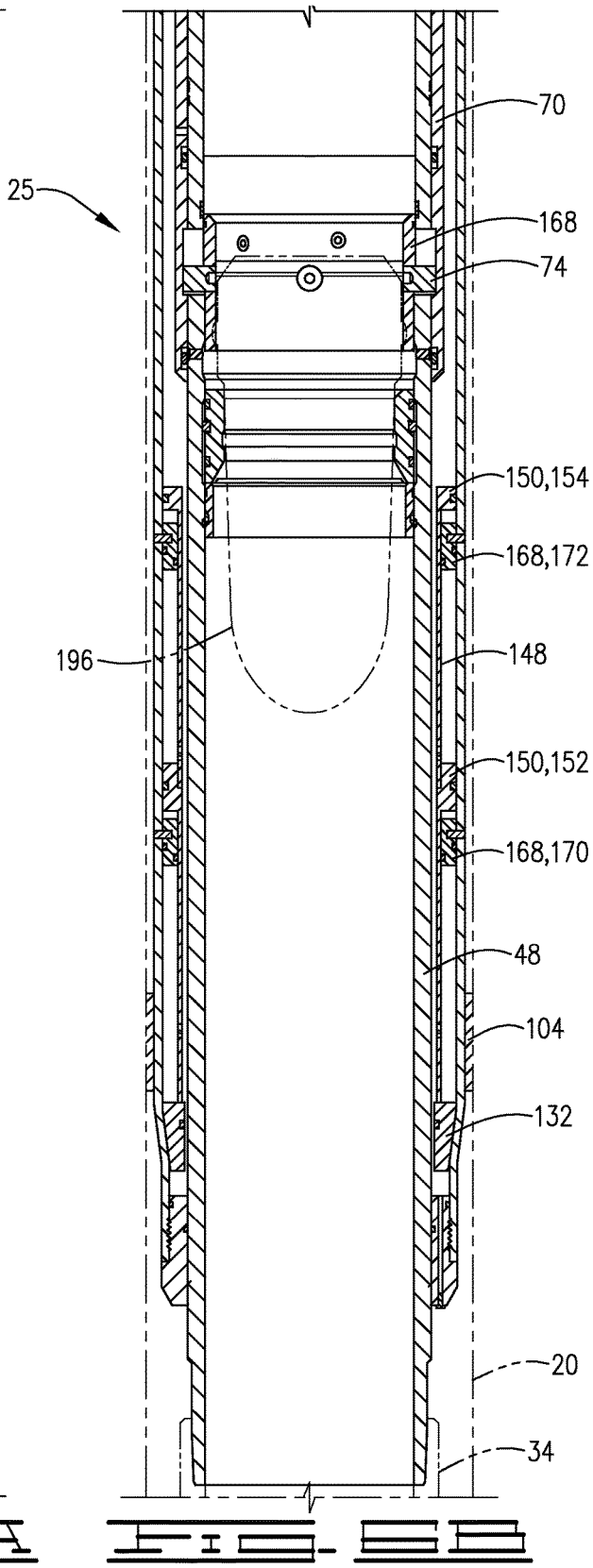

As seen in FIG. 3-5, a fluid port 56, which may be referred to as cementing port 56, is defined through inner mandrel 36 and preferably is defined through lower inner mandrel 48. In the embodiment disclosed, there are a plurality of fluid ports 56 defined through inner mandrel 36. Fluid ports 56 communicate central flow passage 37 with annular space 40. An anchor ring 60 is connected in inner mandrel 36 and, as shown, is connected in lower inner mandrel 48 with a retainer ring 61 of a type known in the art. Retainer ring 61 is disposed in a retainer ring groove 62 in lower inner mandrel 48 and is radially outwardly biased by the natural spring resiliency of the retainer ring. At least a portion of retainer ring 61 is also disposed in a ring groove 64 defined in an outer surface of anchor ring 60. Retainer ring groove 62 and ring groove 64 are configured such that when axial forces are applied to anchor ring 60, retainer ring 61 cannot be forced out of ring groove 64 and anchor ring 60 will be held in inner mandrel 36.

An opening sleeve 66 is disposed, and preferably detachably connected in mandrel 36 and more specifically in lower inner mandrel 48. Likewise, an operating sleeve 68 is detachably connected in lower inner mandrel 48. A closing sleeve 70 is disposed in annular space 40 about lower inner mandrel 48. Lower inner mandrel 48 has operating slots 72 defined therein. A plurality of connectors 74 operably connect operating sleeve 68 with closing sleeve 70 so that downward movement of operating sleeve 68 will cause closing sleeve 70 to move downwardly.

Outer mandrel 38 has upper end 76 and lower end 78. A connecting sub 80 having threads on an outer surface 82 thereof and likewise on an inner surface 84 thereof connects outer mandrel 38 to inner mandrel 36 at the lower end 78 of outer mandrel 38. Connecting sub 80 may have a relief port 86 with a relief plug 88 inserted therein. Relief plug 88 may be removed to allow the release of fluid in annular space 40. A pressure ring 90 is inserted in annular space 40 at the upper end 76 of outer mandrel 38 and closes off an upper end of the annular space 40 until a predetermined fluid pressure is applied as described below. Pressure ring 90 is held in place by shear pin 91.

Outer mandrel 38 has upper portion 92 and lower portion 94. Lower portion 94 defines an inner diameter 93 (shown in FIG. 3B). A transition or transition portion 96 extends between upper and lower or first and second portions 92 and 94. Outer mandrel 38 has an outer surface 98. Outer surface 98 comprises an outer surface 100 on the lower portion 94 of outer mandrel 38 and an outer surface 102 on the upper portion 92 thereof. Outer mandrel 38 has an inner surface 99. Inner surface 99 comprises an inner surface 101 on the lower portion of 94 of outer mandrel 38 and an inner surface 103 on the upper portion thereof. In the run-in position shown in FIG. 2, outer surface 100 is positioned radially inwardly from outer surface 102.

Figures 2A, 2B:
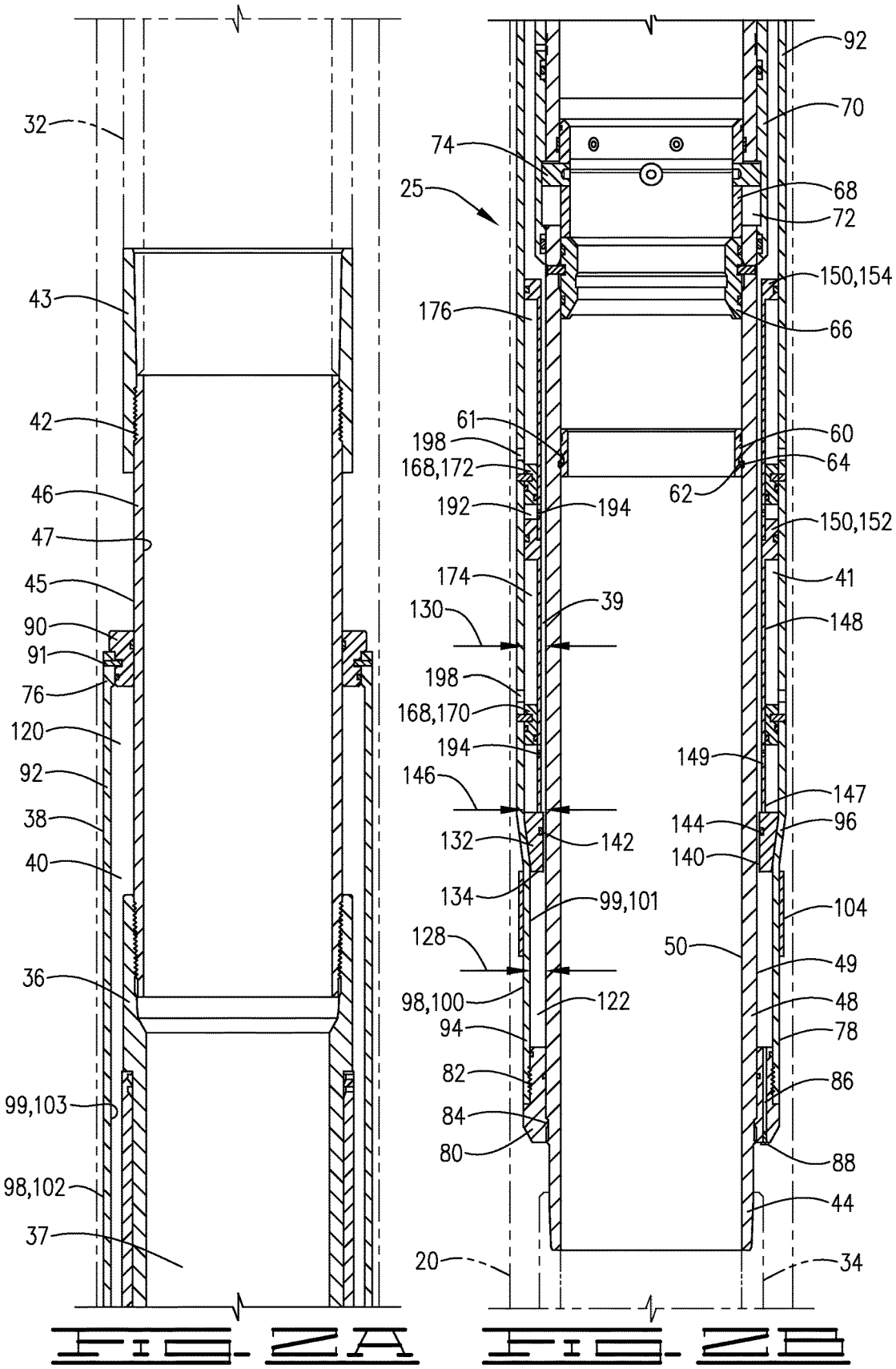
FIGS. 2A and 2B are a cross section of the tool in a run-in position.

At least one, and preferably a plurality of sealing elements 104 are disposed about outer mandrel 38. As shown in FIG. 2 sealing elements 104 are disposed about lower portion 94 on surface 100. Sealing elements 104 may be comprised of elastomeric material such as for example, VITON® FKM (Vicon) FLOREL® or AFLAF. The examples provided herein are non-limiting. Sealing elements 104 are affixed to lower portion 94 of outer mandrel 38 and in a set position in a well as shown in FIGS. 4-6 will sealingly engage previously installed casing 20.

Sealing elements 104 are mounted to lower portion 94 of outer mandrel 38. Outer surface 100 can include grooves to assist in mounting sealing elements 104. At the upper and lower ends of the sealing elements there can be rings having sharp points (not shown) that extend radially outwardly from outer surface 100. The rings are preferably integrally fabricated with outer mandrel 38 and, in the expanded position shown in FIGS. 4 and 5, the rings engage previously installed casing 20. The rings can act as extrusion limiters which will prevent the sealing elements 104 from extruding longitudinally and will help to assure an adequate hydraulic seal.

Annular space 40 has upper end 120 in which pressure ring 90 is placed and has lower end 122 at which connecting sub 80 is attached. Annular space 40 has a width 130 just above transition 96 and has a width 128 just below transition 96 prior to the plastic deformation of lower portion 94 of outer mandrel 38. It will be noted that generally width 130 will be greater than width 128. An expansion cone 132 which may also be referred to as expansion wedge 132 is disposed about inner mandrel 36 and in the embodiment shown is disposed about lower inner mandrel 48. Expansion cone 132 has a leading edge 134 and angles radially outwardly therefrom to an outermost diameter 136 (see FIG. 3B). An inner surface 140 of expansion cone 132 engages outer surface 49 of lower inner mandrel 48. A groove 142 is defined in inner surface 140 and has a sealing ring, which may be, for example, an O-ring 144, disposed therein so that expansion cone 132 slidingly and sealingly engages lower inner mandrel 48.

The width 146 of expansion cone 132 at outermost diameter 136 is greater than the width 128 of the portion of annular space 40 below transition 96 prior to plastic deformation of lower portion 94 of outer mandrel 38. Thus, in the run-in position, outermost diameter 136 is greater than the inner diameter 93 of lower portion 94 of outer mandrel 38.

Connected to expansion cone 132 is sleeve 148. Sleeve 148 connects expansion cone 132 to force multipliers 150. Force multipliers 150 comprise one or more piston rings. As illustrated, force multipliers 150 comprise a first or intermediate piston ring 152 and a second or terminus piston ring 154. Expansion cone 132 is located at first end or lower end of sleeve 148 and terminus piston ring 154 is located at the second end or upper end of sleeve 148. Intermediate piston ring 152 is spaced between expansion cone 132 and terminus piston ring 154. Expansion cone 132, sleeve 148 and force multipliers 150 can be formed as an integral unit or expansion cone 132 and force multipliers 150 can be otherwise fixedly secured to sleeve 148. Whether integral or separate pieces connected together, the connections should be such that force applied to the force multipliers is transmitted via sleeve 148 to expansion cone 132.

As can be seen from FIG. 3B, intermediate piston ring 152 has an outer surface 156, which engages inner surface 103 of outer mandrel 38. A groove 158 is defined in outer surface 156 and has a sealing ring, which may be, for example, an O-ring 160, disposed therein so that intermediate piston ring 152 slidingly and sealingly engages inner surface 103. Similarly, terminus piston ring 154 has an outer surface 162, which engages inner surface 103 of outer mandrel 38. A groove 164 is defined in outer surface 162 and has a sealing ring which may be for example, an O-ring 166 disposed therein so that terminus piston ring 154 slidingly and sealingly engages inner surface 103.

Spaced between neighboring piston rings and between expansion cone 132 and its neighboring piston ring are force rings 168. Accordingly, as illustrated, force ring 170 is located between expansion cone 132 and intermediate piston ring 152 and force ring 172 is located between intermediate piston ring 152 and terminus piston ring 154. As can be seen from the figures, the force rings and piston rings have an annular space or gap between them. The rings are located so that gap 174 between force ring 170 and intermediate piston ring 152 is approximately equal to gap 176 between force ring 172 and terminus piston ring 154. Additionally, the length of gap 174 and gap 176 can be greater than the length of sealing elements 104 to, thus, ensure that expansion cone 132 travels completely through the portion of outer mandrel 38 having sealing elements 104.

As can be seen from FIG. 3B, the force rings 168 each have an inner surface 178, which engages the outer surface 147 of sleeve 148, and an outer surface 179 which engages inner surface 103 of outer mandrel 38. A groove 180 is defined in inner surface 178 and has a sealing ring, which may be, for example, an O-ring 182, disposed therein so that the force rings 168 slidingly and sealingly engage outer surface 147. Force rings 168 are fixedly attached to outer mandrel 38 by pin 184 so that they do not move relative to outer mandrel 38. Force rings 168 can also have a groove 186 in outer surface 179 and can have a sealing ring which may be for example an O-ring 188 disposed therein to ensure that the force rings 168 sealingly engage inner surface 103.

Sleeve 148 divides a portion of annular space 40 into an inner annular space 39 and an outer annular space 41. Additionally, outer annular space 41 is divided by expansion cone 132, force multipliers 150 and force rings 168 into annular spaces or gaps. Thus, as mention above, gap 174 is between intermediate piston ring 152 and force ring 170 and gap 176 is between terminus piston ring 154 and force ring 172. Additionally, gap 190 is between expansion cone 132 and force ring 170, and gap 192 is between intermediate piston ring 152 and force ring 172. Sleeve 148 has apertures 194 so that gaps 190 and 192 are in fluid flow communication with inner annular space 39 and, when fluid port 56 is uncovered, gaps 190 and 192 are in fluid flow communication with central flow passage 37 through inner annular space 39. Gaps 174 and 176 are not in fluid flow communication with inner annular space 39 or central flow passage 37. Accordingly, pressure can be increased into gaps 190 and 192 by introduction of fluid pressure through central flow passage 37 and, subsequently, fluid port 56, inner annular space 39 and apertures 194, while the pressure in gaps 174 and 176 is at a lower pressure. Typically, gaps 174 and 176 are maintained at the hydrostatic pressure of wellbore 15 by apertures 198. The use of apertures 198 prevents hydraulic pressure lock of the force multipliers or premature expansion of the force multipliers during running in the hole.

The operation of cementing tool 25 is as follows. Tool 25 is lowered into the well 10 on casing 30. It will be understood that the lower end of casing 30 (not shown) will have float equipment such as a float collar or float shoe on an end thereof. Cement will be flowed therethrough to fill the annulus between wellbore 15 and lower casing portion 34. Preferably, cement is flowed therethrough so that it will fill the annulus until it reaches a point above upper end 120 of annular space 40. Once the desired amount of cement has been flowed through a lower end of lower portion 34 of casing 30, a plug, such as for example, plug 196 can be displaced into casing 30 so that it will engage opening sleeve 66. Plug 196 is shown in phantom lines in FIGS. 3-6 so that other details of the cementing tool 25 may be clearly seen and described. FIGS. 3A and 3B show tool 25 after plug 196 has been dropped but prior to the time expansion cone 132 is urged through annular space 40. Plug 196 may be displaced through casing 30 with a circulation fluid of a type known in the art. Fluid pressure is increased until shear pins that connect opening sleeve 66 to inner mandrel 36 break. As shown in FIG. 3B, once the shear pins break, sleeve 66 will move into inner mandrel 36 to uncover fluid ports 56. Circulation fluid is displaced through central flow passage 37 and is communicated into annular space 40. As shown in the drawings, fluid is communicated through flow ports 56 into annular space 40 so that it flows from inner annular space 39 through apertures 194 and into gaps 190 and 192. Thus, the fluid will apply pressure directly to expansion cone 132 in gap 190. Additionally, it will apply pressure to intermediate piston ring 152 in gap 192 and to terminus piston ring 154 in annular space 40 above terminus piston ring 154. The pressure applied to intermediate piston ring 152 and terminus piston ring 154 is transferred to expansion cone 132 via sleeve 148. As can be seen from FIG. 4B, pressure is increased so that expansion cone 132 will be urged downwardly towards the lower end 122 of annular space 40. As the expansion cone 132 moves towards lower end 122 of annular space 40, it will radially expand outer mandrel 38 and more specifically will radially expand the lower portion 94 thereof.

As explained herein, the outermost diameter 136 of expansion cone 132 is greater than the undeformed inner diameter 93 of the lower portion 94 of outer mandrel 38. As the expansion cone 132 is forced downwardly through the lower portion of annular space 40, outer mandrel 38 will radially expand. Expansion cone 132 is configured such that it will plastically deform outer mandrel 38 an amount sufficient to move sealing elements 104 into engagement with previously installed casing 20.

Referring now to FIGS. 5A and 5B, after expansion cone 132 has been moved through the lower portion of annular space 40 so that sealing elements 104 are in engagement with previously installed casing 20, additional fluid pressure is applied through flow passage 37 and fluid ports 56 into annular space 40 so that pins 91 holding pressure ring 90 in place are ruptured or sheared allowing pressure ring 90 to move out of place so that fluid may be circulated through upper end 120. Fluid will continue to be circulated through upper end 120 to wash out the leading edge of cement previously displaced into well 10. Subsequently, cement will be displaced through the central flow passage 37 and flow ports 56 behind the circulation fluid until a sufficient amount has been displaced into the well to cement casing 30 and more specifically to cement the upper portion 32 thereof in previously installed casing 20. After cementing is complete, operating sleeve 68 and closing sleeve 70 can be moved downward to close off flow ports 56, as shown in FIGS. 6A and 6B.

In one embodiment outer mandrel 38 is fabricated from an alloy steel having minimum yield strength of about 40,000 to 125,000 psi in order to optimally provide high strength and ductility. Examples of alloy steels that may be used are 4130 and 4140 alloy steels selected to have characteristics that will provide for radial expansion and plastic deformation without tearing or splitting. Material strengths and thicknesses are selected to provide performance (burst and collapse) required for specific well conditions. The thicknesses and relationships between the upper and lower portions of outer mandrel 38 and expansion cone diameter are balanced to achieve the proper contact stress with the casing 20 for pressure containment. Other alloys that may be used include Super 13Cr and INCONEL 825. The examples herein are not limiting and other materials with characteristics that provide for plastic deformation and proper sealing may be selected.

To further illustrate the invention, several different embodiments will now be outlined. In one such embodiment there is provided a downhole tool for creation of an annular seal in a well. The downhole tool comprises an inner mandrel, an outer mandrel, a sealing element, a sleeve and a first force ring. The inner mandrel defines a central flow passage and has a fluid port through a wall thereof. The outer mandrel is disposed about the inner mandrel. The inner and outer mandrels define an annular space therebetween. The sealing element is disposed about a portion of the outer mandrel. The sleeve is positioned in the annular space having an expansion cone connected to a first end and a terminus piston ring connected to a second end. The terminus piston ring sealingly and slidingly engages the outer mandrel. The first force ring is positioned in the annular space, connected to the outer mandrel and sealingly and slidingly engages the sleeve. The first force ring is located between the expansion cone and the terminus piston ring.

Further this embodiment can comprise a pressure ring, which is positioned in the annular space and located on the opposite side of the terminus piston ring from the first force ring. The pressure ring is held in position until a predetermined fluid pressure is applied to it. This embodiment can also comprise an opening sleeve positioned in the inner mandrel and movable from a closed position, in which the opening sleeve covers the fluid port, to an open position, in which the fluid port is not covered by the opening sleeve.

Further, fluid pressure can be communicated through the fluid port from the central flow passage, which will cause force to be exerted on the terminus piston ring and the expansion cone resulting in a cumulative force pushing the expansion cone through at least a portion of the annular space to deform the portion of the outer mandrel so that the sealing element engages the well. Also, the sleeve can have a plurality of apertures positioned to convey the fluid pressure to the expansion cone.

This embodiment can comprise an intermediate piston ring and a second force ring. The intermediate piston ring can be connected to the sleeve between the first force ring and the terminus piston ring wherein the intermediate piston ring sealingly and slidingly engages the outer mandrel. The second force ring can be positioned in the annular space, connected to the outer mandrel and sealingly and slidingly engaging the sleeve. The second force ring can be located between the intermediate piston ring and the terminus piston ring. Additionally, the downhole tool can further comprise a pressure ring positioned in the annular space and located on the opposite side of the terminus piston ring from the second force ring. The pressure ring is held in place until a predetermined force is applied to it. Also, the downhole tool can comprise an opening sleeve positioned in the inner mandrel and movable from a closed position, in which the opening sleeve covers the fluid port, to an open position, in which the fluid port is not covered by the opening sleeve. Further, fluid pressure communicated through the fluid port from the central flow passage can cause force to be exerted on the terminus piston ring, the intermediate piston ring and the expansion cone resulting in a cumulative force pushing the expansion cone through at least a portion of the annular space to deform the portion of the outer mandrel so that the sealing element engages the well. Additionally, the sleeve can have a plurality of apertures positioned to convey the fluid pressure to the intermediate piston ring and the expansion cone.

Alternatively, this embodiment can comprise a plurality of intermediate piston rings and a plurality of intermediate force rings. The plurality of intermediate piston rings can be connected to the sleeve between the first force ring and the terminus piston ring wherein the intermediate piston rings sealingly and slidingly engage the outer mandrel. The plurality of force rings can be positioned in the annular space and interspersed between the intermediate piston rings, the plurality of force rings connected to the outer mandrel and sealingly and slidingly engaging the sleeve. Fluid pressure communicated through the fluid port from the central flow passage can cause force to be exerted on the terminus piston ring, the intermediate piston rings and the expansion cone resulting in a cumulative force pushing the expansion cone through at least a portion of the annular space to deform the portion of the outer mandrel so that the sealing element engages the well. Also, the sleeve can have a plurality of apertures positioned to convey the fluid pressure to the intermediate piston rings and the expansion cone.

In another embodiment, a downhole tool for creation of an annular seal in a well is provided. The downhole tool comprises an inner mandrel, an outer mandrel, a sealing element, a sleeve, a first force ring, a second force ring, a pressure ring and an opening sleeve. The inner mandrel defines a central flow passage and has a fluid port through a wall thereof. The outer mandrel is disposed about the inner mandrel. The inner and outer mandrels define an annular space therebetween. The sealing element is disposed about a portion of the outer mandrel. The sleeve is positioned in the annular space having an expansion cone connected to a first end. A terminus piston ring is connected to a second end and an intermediate piston ring is connected to the sleeve between the expansion cone and the terminus piston ring wherein the terminus piston ring and the intermediate piston ring sealingly and slidingly engage the outer mandrel. The first force ring is positioned in the annular space, connected to the outer mandrel and sealingly and slidingly engaging the sleeve. The first force ring is located between the expansion cone and the intermediate piston ring. The second force ring is positioned in the annular space, connected to the outer mandrel and sealingly and slidingly engaging the sleeve. The second force ring located between the intermediate piston ring and the terminus piston ring. The pressure ring is positioned in the annular space and located on the opposite side of the terminus piston ring from the second force ring. The pressure ring is held in place until a predetermined force is applied to it. The opening sleeve is positioned in the inner mandrel and movable from a closed position, in which the opening sleeve covers the at least one fluid port, to an open position, in which the at least one fluid port is not covered by the opening sleeve. Fluid pressure communicated through the fluid port from the central flow passage will cause force to be exerted on the terminus piston ring, the intermediate piston ring and the expansion cone, resulting in a cumulative force pushing the expansion cone through at least a portion of the annular space to deform the portion of the outer mandrel so that the sealing element engages the well. The sleeve has a plurality of apertures positioned to convey the fluid pressure to the intermediate piston ring and the expansion cone.

In yet anther embodiment, a downhole tool for creation of an annular seal in a well is provided. The downhole tool comprises an inner mandrel, an outer mandrel, a sealing element, and expansion cone, and a first force multiplier. The inner mandrel defines a central flow passage and has a fluid port through a wall thereof. The outer mandrel is disposed about the inner mandrel. The inner and outer mandrels defining an annular space therebetween wherein fluid introduced into the central flow passage can flow into the annular space through the fluid port. The sealing element is disposed about a portion of the outer mandrel. The expansion cone is positioned in the annular space. The first force multiplier is positioned in the annular space and operationally connected to the expansion cone. Fluid communicated through the fluid port from the central flow passage will apply force to the first force multiplier and the expansion cone such that the expansion cone is forced through the annular space to deform the portion of the outer mandrel so that the sealing element attached to the outer mandrel will engage the well.

Further in this embodiment, the force exerted on the force multiplier can be cumulative with the force exerted on the expansion cone. Also, there can be a first sleeve disposed about the inner mandrel and connected to the expansion cone at a first end and connected to the first force multiplier at a second end so that the first sleeve extends through a first portion of the annular space between the first force multiplier and the expansion cone and divides the first portion of the annular space into a first inner annular space and a first outer annular space such that fluid introduced in the annular space enters the first inner annular space. Also, the first force multiplier can be a piston ring extending from the second end of the first sleeve to the outer mandrel and that sealingly engages the outer mandrel. Additionally, there can be a first force ring connected to the outer mandrel, located between the expansion cone and first force multiplier and in sealing engagement with the first sleeve. The first sleeve can have an aperture that allows fluid flow communication between the first inner annular space and the first outer annular space between the first force ring and the expansion cone. Additionally, there can be no fluid flow communication between the first inner annular space and the first outer annular space between the first force ring and first force multiplier. Further, the first sleeve and the first force ring can be slidingly engaged.

Additionally, this embodiment can have a second force multiplier and a second sleeve disposed about the inner mandrel and connected to the first force multiplier at a first end and connected to the second force multiplier at a second end so that the second sleeve extends through a second portion of the annular space between the first force multiplier and the second force multiplier and divides the second portion of the annular space into a second inner annular space and a second outer annular space such that fluid introduced in the annular space enters the second inner annular space. The second force multiplier can be a piston ring extending from the second end of the second sleeve to the outer mandrel and that sealingly engages the outer mandrel. Additionally, the downhole tool can comprise a second force ring connected to the outer mandrel, located between the first force multiplier and the second force multiplier and in sealing engagement with the second sleeve. The second sleeve can have an aperture that allows fluid flow communication between the second inner annular space and the second outer annular space between the first force multiplier and the second force ring. There can be no fluid flow communication between the second inner annular space and the second outer annular space between the second force ring and the second force multiplier. Also, the second sleeve and the second force ring are slidingly engaged.

In yet another embodiment there is provided a method of cementing a casing in a well. The method comprises:

(a) lowering a cementing tool into the well on the casing, wherein the cementing tool comprises an inner mandrel and an outer mandrel defining an annular space therebetween;

(b) pumping a fluid having a fluid pressure through the inner mandrel and into the annular space;

(c) exerting force on an expansion cone and a piston ring such that the expansion cone is moved through the annular space with the force being exerted by exposing a first side of the expansion cone and a first side of the piston ring to the fluid pressure, and the expansion cone and the piston ring are operatively connected such that the force on the piston ring is transferred to the expansion cone;

(d) plastically deforming a portion of the tool so that it engages a previously installed casing in the well, wherein the plastic deformation is caused by the movement of the expansion cone in step (c); and (e) pumping cement through the tool into the annulus between the previously installed casing and the casing used to lower the cementing tool into the well.

In this method, the force exerted on the piston ring can be cumulative with the force exerted on the expansion cone. Also, a second side of the expansion cone and a second side of the piston ring can be isolated from the fluid pressure. Additionally, the piston ring can be two or more piston rings with each piston ring having a first side exposed to the fluid pressure and a second side isolated from the fluid pressure.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. A downhole tool for creation of an annular seal in a well, the downhole tool comprising:

an inner mandrel defining a central flow passage and having a fluid port through a wall thereof;

an outer mandrel disposed about the inner mandrel, the inner and outer mandrels defining an annular space therebetween;

a sealing element disposed about a portion of the outer mandrel;

a sleeve positioned in the annular space having an expansion cone connected to a first end and a terminus piston ring connected to a second end wherein the terminus piston ring sealingly and slidingly engages the outer mandrel; and a first force ring positioned in the annular space, connected to the outer mandrel and sealingly and slidingly engaging the sleeve, the first force ring located between the expansion cone and the terminus piston ring.

2. The downhole tool of claim 1 further comprising a pressure ring positioned in the annular space and located on the opposite side of the terminus piston ring from the first force ring, the pressure ring being held in position until a predetermined fluid pressure is applied to it.

3. The downhole tool of claim 1 further comprising an opening sleeve positioned in the inner mandrel and movable from a closed position, in which the opening sleeve covers the fluid port, to an open position, in which the fluid port is not covered by the opening sleeve.

4. The downhole tool of claim 1 wherein the sleeve has a plurality of apertures positioned to convey the fluid pressure to the expansion cone and wherein fluid pressure communicated through the fluid port from the central flow passage will cause force to be exerted on the terminus piston ring, in a part of the annular space operatively above the terminus piston ring, and on the expansion cone resulting in a cumulative force pushing the expansion cone through at least a portion of the annular space to deform the portion of the outer mandrel so that the sealing element engages the well.

5. The downhole tool of claim 1 further comprising:

an intermediate piston ring connected to the sleeve between the first force ring and the terminus piston ring wherein the intermediate piston ring sealingly and slidingly engages the outer mandrel;

a second force ring positioned in the annular space, connected to the outer mandrel and sealingly and slidingly engaging the sleeve, the second force ring located between the intermediate piston ring and the terminus piston ring; and a pressure ring positioned in the annular space and located on the opposite side of the terminus piston ring from the second force ring, the pressure ring being held in place until a predetermined force is applied to it.

6. The downhole tool of claim 5 further comprising an opening sleeve positioned in the inner mandrel and movable from a closed position, in which the opening sleeve covers the fluid port, to an open position in which the fluid port is not covered by the opening sleeve.

7. The downhole tool of claim 5 wherein the sleeve has a plurality of apertures positioned to convey the fluid pressure to the intermediate piston ring and the expansion cone and wherein fluid pressure communicated through the fluid port from the central flow passage will cause force to be exerted on the terminus piston ring, in a part of the annular space operatively above the terminus piston ring, on the intermediate piston ring and on the expansion cone resulting in a cumulative force pushing the expansion cone through at least a portion of the annular space to deform the portion of the outer mandrel so that the sealing element engages the well.

8. The downhole tool of claim 1 further comprising:

a plurality of intermediate piston rings connected to the sleeve between the first force ring and the terminus piston ring wherein the intermediate piston rings sealingly and slidingly engage the outer mandrel; and a plurality of force rings positioned in the annular space and interspersed between the intermediate piston rings, the plurality of force rings connected to the outer mandrel and sealingly and slidingly engaging the sleeve.

9. The downhole tool of claim 8 wherein the sleeve has a plurality of apertures positioned to convey the fluid pressure to the intermediate piston rings and the expansion cone, and wherein fluid pressure communicated through the fluid port from the central flow passage will cause force to be exerted on the terminus piston ring, in a part of the annular space operatively above the terminus piston ring, the intermediate piston rings and on the expansion cone, resulting in a cumulative force pushing the expansion cone through at least a portion of the annular space to deform the portion of the outer mandrel so that the sealing element engages the well.

10. A downhole tool for creation of an annular seal in a well, the downhole tool comprising:

an inner mandrel defining a central flow passage and having a fluid port through a wall thereof;

an outer mandrel disposed about the inner mandrel, the inner and outer mandrels defining an annular space therebetween wherein fluid introduced into the central flow passage can flow into the annular space through the fluid port;

a sealing element disposed about a portion of the outer mandrel;

an expansion cone positioned in the annular space;

a first force multiplier positioned in the annular space and operationally connected to the expansion cone, and a first force ring positioned in the annular space between the first force multiplier and the expansion cone and fixedly connected to the outer mandrel, wherein fluid communicated through the fluid port from the central flow passage will apply force at least to the first force multiplier and between the first force ring and the expansion cone, such that the expansion cone is forced through the annular space to deform the portion of the outer mandrel so that the sealing element attached to the outer mandrel will engage the well.

11. The downhole tool of claim 10 further comprising a first sleeve disposed about the inner mandrel and connected to the expansion cone at a first end and connected to the first force multiplier at a second end so that the first sleeve extends through a first portion of the annular space between the first force multiplier and the expansion cone, and divides the first portion of the annular space into a first inner annular space and a first outer annular space such that fluid introduced in the annular space enters the first inner annular space.

12. The downhole tool of claim 11 wherein the first force multiplier is a piston ring extending from the second end of the first sleeve to the outer mandrel and that sealingly engages the outer mandrel and the first force ring is in sealing engagement with the first sleeve, wherein the first sleeve has an aperture that allows fluid flow communication between the first inner annular space and the first outer annular space between the first force ring and the expansion cone and wherein the first sleeve and the first force ring are slidingly engaged.

13. The downhole tool of claim 12 further comprising a second force multiplier and a second sleeve disposed about the inner mandrel and connected to the first force multiplier at a first end and connected to the second force multiplier at a second end so that the second sleeve extends through a second portion of the annular space between the first force multiplier and the second force multiplier and divides the second portion of the annular space into a second inner annular space and a second outer annular space such that fluid introduced in the annular space enters the second inner annular space.

14. The downhole tool of claim 13 wherein the second force multiplier is a piston ring extending from the second end of the second sleeve to the outer mandrel and that sealingly engages the outer mandrel and further comprises a second force ring connected to the outer mandrel, located between the first force multiplier and the second force multiplier and in sealing engagement with the second sleeve, wherein the second sleeve has an aperture that allows fluid flow communication between the second inner annular space and the second outer annular space between the first force multiplier and the second force ring and wherein the second sleeve and the second force ring are slidingly engaged.

15. The downhole tool of claim 10, wherein the first force ring, the first force multiplier and the expansion cone are operationally connected so that when the pressurized fluid is introduced it is introduced adjacent to the first force multiplier, in part of the annular space operably above the first force multiplier, and adjacent to the expansion cone so as to generate a unified force that moves the expansion cone through the annular space to deform the portion of the outer mandrel so that the at least one sealing element attached to the outer mandrel will engage the well.

16. The downhole tool of claim 15 further comprising:

a second force ring; and a second force multiplier wherein the second force ring, the second force multiplier, the first force ring, the first force multiplier and the expansion cone are operationally connected so that when the pressurized fluid is introduced it is introduced adjacent to the second force multiplier, adjacent to the first force multiplier, in a part of the annular space operatively above the first force multiplier, and adjacent to the expansion cone so as to generate a unified force that moves the expansion ring through the annular space to deform the portion of the outer mandrel so that the at least one sealing element attached to the outer mandrel will engage the well.

17. The downhole tool of claim 16 further comprising an opening sleeve positioned in the inner mandrel and movable from a closed position, in which the opening sleeve covers the at least one fluid port to an open position in which the at least one fluid port is not covered by the opening sleeve wherein fluid is communicated through the at least one fluid port in the open position and not in the closed position.

18. A method of cementing a casing in a well, the method comprising:

(a) lowering a cementing tool into the well on a liner, wherein the cementing tool comprises an inner mandrel and an outer mandrel defining an annular space therebetween, the annular space housing an expansion cone operatively connected to a piston ring, and a force ring arranged between the expansion cone and the piston ring;

(b) pumping a fluid having a fluid pressure through the inner mandrel and into the annular space;

(c) exerting force between the expansion cone and the force ring, and on the piston ring, such that the expansion cone is moved through the annular space with the force being exerted by exposing a first side of the expansion cone and a first side of the piston ring to the fluid pressure;

(d) plastically deforming a portion of the tool so that it engages a previously installed casing in the well, wherein the plastic deformation is caused by the movement of the expansion cone; and (e) pumping cement through the tool into the annulus between the previously installed casing and the liner used to lower the cementing tool into the well.

19. The method of claim 18 wherein the force exerted on the piston ring is cumulative with the force exerted on the expansion cone.

20. The method of claim 19 wherein the piston ring comprises two or more piston rings with each piston ring having a first side exposed to the fluid pressure and a second side isolated from the fluid pressure.

* * * * *